US011384987B2

(12) United States Patent
Sathyamurthi et al.

(10) Patent No.: US 11,384,987 B2
(45) Date of Patent: Jul. 12, 2022

(54) COOLING SYSTEM

(71) Applicant: Lennox Industries, Inc., Richardson, TX (US)

(72) Inventors: Vijaykumar Sathyamurthi, Frisco, TX (US); Der-Kai Hung, Dallas, TX (US); Hong Lin, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 216 days.

(21) Appl. No.: 16/542,627

(22) Filed: Aug. 16, 2019

(65) Prior Publication Data

US 2021/0048251 A1 Feb. 18, 2021

(51) Int. Cl.

| | |
|---|---|
| ***F28D 1/053*** | (2006.01) |
| ***F28D 15/04*** | (2006.01) |
| ***F28D 1/04*** | (2006.01) |
| *F28D 15/02* | (2006.01) |

(52) U.S. Cl.

CPC ..... *F28D 1/05391* (2013.01); *F28D 1/0417* (2013.01); *F28D 15/043* (2013.01); *F28D 2015/0225* (2013.01)

(58) Field of Classification Search

CPC ..... F28D 1/05391; F28D 1/0417

See application file for complete search history.

(56) References Cited

U.S. PATENT DOCUMENTS

| | | | | |
|---|---|---|---|---|
| 2,124,291 | A * | 7/1938 | Fleisher | F28D 1/0417 165/101 |
| 5,086,835 | A * | 2/1992 | Shinmura | F28D 1/0435 123/41.51 |
| 6,116,048 | A * | 9/2000 | Hebert | F25B 39/02 62/525 |
| 6,408,939 | B1 * | 6/2002 | Sugimoto | F28D 1/0435 165/135 |
| 2003/0066633 | A1 * | 4/2003 | Lee | F28D 1/0417 165/144 |
| 2006/0054312 | A1 * | 3/2006 | Kim | F28F 9/262 165/146 |
| 2019/0242657 | A1 * | 8/2019 | Ignatiev | F28D 20/021 |
| 2020/0064074 | A1 * | 2/2020 | Wan | F28D 15/0266 |

* cited by examiner

*Primary Examiner* — Gordon A Jones

(74) *Attorney, Agent, or Firm* — Baker Botts L.L.P.

(57) ABSTRACT

An apparatus includes first and second microchannel heat exchangers and first and second pipes. The first heat exchanger includes a first inlet, a second inlet, a first tube, a second tube, a first outlet, and a second outlet. Refrigerant at the first inlet is directed through the first tube to the first outlet and the first pipe. Refrigerant at the second inlet is directed through the second tube to the second outlet and the second pipe. The second heat exchanger includes a third inlet, a fourth inlet, a third tube, a fourth tube, a third outlet, and a fourth outlet. The third inlet directs refrigerant from the first pipe through the third tube towards the third outlet. The fourth inlet directs the refrigerant from the second pipe through the fourth tube towards the fourth outlet. The first pipe overlaps the second pipe between the two heat exchangers.

13 Claims, 12 Drawing Sheets

COOLING SYSTEM

TECHNICAL FIELD

This disclosure relates generally to a cooling system.

BACKGROUND

Cooling systems may cycle a refrigerant to cool various spaces. For example, a refrigeration system may cycle refrigerant to cool spaces near or around refrigeration loads.

SUMMARY

Cooling systems cycle refrigerant to cool various spaces. For example, a refrigeration system cycles refrigerant to cool spaces. Air to be cooled flows over a low side heat exchanger (e.g., an evaporator) that carries cold refrigerant. The refrigerant enters the low side heat exchanger and absorbs heat from the air surrounding the heat exchanger, thereby cooling the air. That cooled air is then circulated (e.g., by fan) to various spaces to cool those spaces. The heated refrigerant from the heat exchanger is then sent to a compressor that compresses the refrigerant to a higher pressure to facilitate heat rejection to ambient outside air in a separate high side heat exchanger (e.g., condenser). The high side heat exchanger removes heat from the refrigerant.

In certain installations, the high side heat exchanger may be a microchannel heat exchanger. Microchannel heat exchangers typically include several flat, thin tubes that are sectioned into several smaller channels called microchannels. Refrigerant can flow through these microchannels and heat is transferred to or from the refrigerant to the surrounding air while the refrigerant flows through these microchannels. These microchannels effectively increase the heat transfer surface area relative to sending the refrigerant through a singular tube or pipe. Thus, these microchannels may improve heat transfer to or from the refrigerant.

Some cooling systems also include more than one compressor. The speed of these compressors may be varied during operation to adjust for different cooling needs. For example, when cooling needs are not high, one or more of these compressors may be turned off or slowed down to save energy. In these systems, each compressor may have a separate, dedicated microchannel heat exchanger. For example, in a system with two compressors, the high side heat exchanger may include two microchannel heat exchangers, one for each compressor. These heat exchangers can be arranged in two different configurations, row-split and face-split.

In the face-split configuration, the microchannel heat exchangers are typically arranged one on top of the other perpendicular to the direction of airflow. One problem with this arrangement occurs in part-load operation where one compressor is turned off. Despite turning off one compressor, it may not be possible to reduce the airflow because the other half of the heat exchanger is active, which reduces system efficiency.

Another configuration is the row-split design in which one microchannel heat exchanger is positioned in front of the other microchannel heat exchanger along the direction of airflow. A disadvantage of this configuration is that the microchannel heat exchanger in the front is cooled with colder air than the microchannel heat exchanger in the back. Thus, the refrigerant flowing through the microchannel heat exchanger in the front will experience more heat transfer than the refrigerant flowing through the microchannel heat exchanger in the back, which reduces system efficiency.

This disclosure contemplates an unconventional cooling system that includes an unconventional arrangement of microchannel heat exchangers. Generally, the microchannel heat exchangers are arranged one in front of the other along a direction of airflow, as discussed above. However, instead of dedicating each microchannel heat exchanger to a compressor, each microchannel heat exchanger is shared by the compressors. Each microchannel heat exchanger is divided into sections by partitioning baffles such that each section handles refrigerant from a different compressor. Pipes are used to carry the refrigerant from one microchannel heat exchanger to another. These pipes overlap such that the microchannel heat exchangers are intertwined. In this manner, refrigerant from each compressor can flow through the microchannel heat exchanger at the front of the arrangement (e.g., the microchannel heat exchanger that is exposed to the most and/or coldest airflow). Additionally, even if a compressor is shut off, the airflow hitting the microchannel heat exchanger in the front of the arrangement would not be wasted and the face of the heat exchanger is actively used to transfer heat, which improves system efficiency.

According to an embodiment, an apparatus includes a first microchannel heat exchanger, a first pipe, a second pipe, and a second microchannel heat exchanger. The first microchannel heat exchanger receives a refrigerant and includes a first inlet, a second inlet, a first tube, a second tube, a first outlet, a second outlet, a first partition, and a second partition. The first inlet receives the refrigerant. The second inlet receives the refrigerant. The first tube includes first microchannels. The second tube includes second microchannels. The refrigerant received by the first inlet is directed through the first microchannels of the first tube to the first outlet. The refrigerant received by the second inlet is directed through the second microchannels of the second tube to the second outlet. The first partition prevents the refrigerant received by the first inlet from flowing to the second tube. The second partition prevents the refrigerant directed through the first tube from flowing to the second outlet. The first pipe receives the refrigerant from the first outlet. The second pipe receives the refrigerant from the second outlet. A portion of the first pipe overlaps a portion of the second pipe between the first microchannel heat exchanger and the second microchannel heat exchanger. The second microchannel heat exchanger includes a third inlet, a fourth inlet, a third tube, a fourth tube, a third outlet, a fourth outlet, a third partition, and a fourth partition. The third inlet receives the refrigerant from the first pipe. The fourth inlet receives the refrigerant from the second pipe. The third tube includes third microchannels. The fourth tube includes fourth microchannels. The refrigerant received by the third inlet is directed through the third microchannels of the third tube towards the third outlet. The refrigerant received by the fourth inlet is directed through the fourth microchannels of the fourth tube towards the fourth outlet. The third partition prevents the refrigerant received by the third inlet from flowing to the fourth tube. The fourth partition prevents the refrigerant directed through the third tube from flowing to the fourth outlet. The first microchannel heat exchanger is positioned behind the second microchannel heat exchanger along a first direction such that air flowing in the first direction contacts the second microchannel heat exchanger before the first microchannel heat exchanger.

According to another embodiment, a method includes receiving, by a first inlet of a first microchannel heat exchanger, a refrigerant and receiving, by a second inlet of the first microchannel heat exchanger, the refrigerant. The method also includes directing the refrigerant received by the first inlet through first microchannels of a first tube of the first microchannel heat exchanger to a first outlet of the first microchannel heat exchanger and directing the refrigerant received by the second inlet through second microchannels of a second tube of the first microchannel heat exchanger to a first outlet of the first microchannel heat exchanger. The method further includes receiving, by a first pipe, the refrigerant from the first outlet and receiving, by a second pipe, the refrigerant from the second outlet. A portion of the first pipe overlaps a portion of the second pipe between the first microchannel heat exchanger and the second microchannel heat exchanger. The method additionally includes receiving, by a third inlet of a second microchannel heat exchanger, the refrigerant from the first pipe and receiving, by a fourth inlet of the second microchannel heat exchanger, the refrigerant from the second pipe. The method also includes directing the refrigerant received by the third inlet through third microchannels of a third tube of the second microchannel heat exchanger to a third outlet of the second microchannel heat exchanger and directing the refrigerant received by the fourth inlet through fourth microchannels of a fourth tube of the second microchannel heat exchanger to a fourth outlet of the second microchannel heat exchanger. The first microchannel heat exchanger is positioned behind the second microchannel heat exchanger along a first direction such that air flowing in the first direction contacts the second microchannel heat exchanger before the first microchannel heat exchanger.

According to yet another embodiment, a system includes a first compressor, a second compressor, and a high side heat exchanger. The first compressor compresses a refrigerant. The second compressor compresses the refrigerant. The high side heat exchanger removes heat from the refrigerant from the first and second compressors. The high side heat exchanger includes a first microchannel heat exchanger, a first pipe, a second pipe, and a second microchannel heat exchanger. The first microchannel heat exchanger includes a first inlet, a second inlet, a first tube, a second tube, a first outlet, a second outlet, a first partition, and a second partition. The first inlet receives the refrigerant from the first compressor. The second inlet receives the refrigerant from the second compressor. The first tube includes first microchannels. The second tube includes second microchannels. The refrigerant received by the first inlet is directed through the first microchannels of the first tube to the first outlet. The refrigerant received by the second inlet is directed through the second microchannels of the second tube to the second outlet. The first partition prevents the refrigerant received by the first inlet from flowing to the second tube. The second partition prevents the refrigerant directed through the first tube from flowing to the second outlet. The first pipe receives the refrigerant from the first outlet. The second pipe receives the refrigerant from the second outlet. A portion of the first pipe overlaps a portion of the second pipe between the first microchannel heat exchanger and the second microchannel heat exchanger. The second microchannel heat exchanger includes a third inlet, a fourth inlet, a third tube, a fourth tube, a third outlet, a fourth outlet, a third partition, and a fourth partition. The third inlet receives the refrigerant from the first pipe. The fourth inlet receives the refrigerant from the second pipe. The third tube includes third microchannels. The fourth tube includes fourth microchannels. The refrigerant received by the third inlet is directed through the third microchannels of the third tube towards the third outlet. The refrigerant received by the fourth inlet is directed through the fourth microchannels of the fourth tube towards the fourth outlet. The third partition prevents the refrigerant received by the third inlet from flowing to the fourth tube. The fourth partition prevents the refrigerant directed through the third tube from flowing to the fourth outlet. The first microchannel heat exchanger is positioned behind the second microchannel heat exchanger along a first direction such that air flowing in the first direction contacts the second microchannel heat exchanger before the first microchannel heat exchanger.

Certain embodiments provide one or more technical advantages. For example, an embodiment allows refrigerant from two different compressors to flow through a microchannel heat exchanger positioned at the front of airflow. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
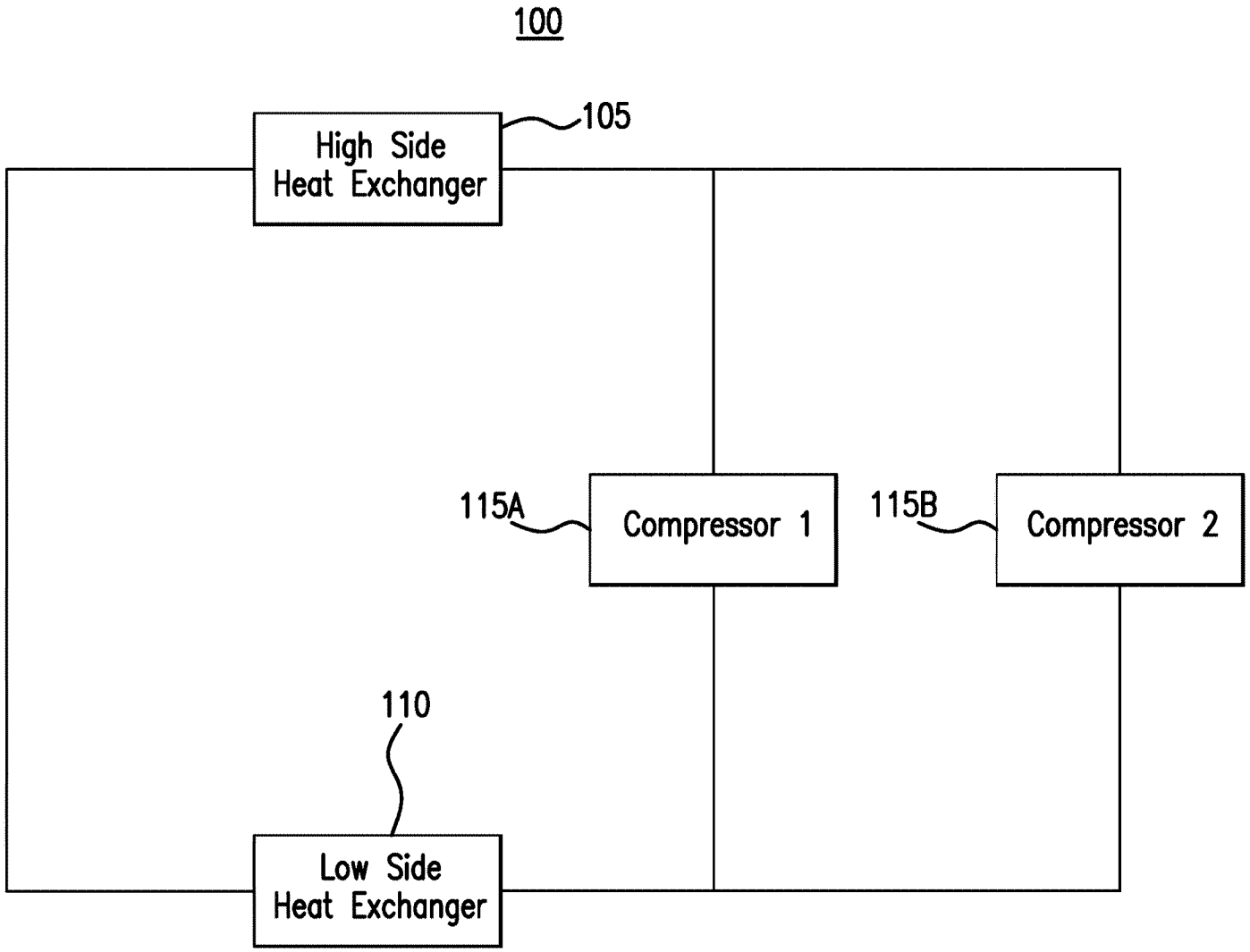
FIG. 1 illustrates an example cooling system.

Embodiments of the present disclosure and its advantages are best understood by referring to FIGS. 1 through 9 of the drawings, like numerals being used for like and corresponding parts of the various drawings.

Cooling systems cycle refrigerant to cool various spaces. For example, a refrigeration system cycles refrigerant to cool spaces. Air to be cooled flows over a low side heat exchanger (e.g., an evaporator) that carries cold refrigerant. The refrigerant enters the low side heat exchanger and absorbs heat from the air surrounding the heat exchanger, thereby cooling the air. That cooled air is then circulated (e.g., by fan) to various spaces to cool those spaces. The heated refrigerant from the heat exchanger is then sent to a compressor that compresses the refrigerant to a higher pressure to facilitate heat rejection to ambient outside air in a separate high side heat exchanger (e.g., condenser). The high side heat exchanger removes heat from the refrigerant.

In certain installations, the high side heat exchanger may be a microchannel heat exchanger. Microchannel heat exchangers typically include several flat, thin tubes that are sectioned into several smaller channels called microchannels. Refrigerant can flow through these microchannels and heat is transferred to or from the refrigerant to the surrounding air while the refrigerant flows through these microchannels. These microchannels effectively increase the heat transfer surface area relative to sending the refrigerant through a singular tube or pipe. Thus, these microchannels may improve heat transfer to or from the refrigerant.

Some cooling systems also include more than one compressor. The speed of these compressors may be varied during operation to adjust for different cooling needs. For example, when cooling needs are not high, one or more of these compressors may be turned off or slowed down to save energy. In these systems, each compressor may have a separate, dedicated microchannel heat exchanger. For example, in a system with two compressors, the high side heat exchanger may include two microchannel heat exchangers, one for each compressor. These heat exchangers can be arranged in two different configurations, row-split and face-split.

In the face-split configuration, the microchannel heat exchangers are typically arranged one on top of the other perpendicular to the direction of airflow. One problem with this arrangement occurs in part-load operation where one compressor is turned off. Despite turning off one compressor, it may not be possible to reduce the airflow because the other half of the heat exchanger is active, which reduces system efficiency.

Another configuration is the row-split design in which one microchannel heat exchanger is positioned in front of the other microchannel heat exchanger along the direction of airflow. A disadvantage of this configuration is that the microchannel heat exchanger in the front is cooled with colder air than the microchannel heat exchanger in the back. Thus, the refrigerant flowing through the microchannel heat exchanger in the front will experience more heat transfer than the refrigerant flowing through the microchannel heat exchanger in the back, which reduces system efficiency.

This disclosure contemplates an unconventional cooling system that includes an unconventional arrangement of microchannel heat exchangers. Generally, the microchannel heat exchangers are arranged one in front of the other along a direction of airflow, as discussed above. However, instead of dedicating each microchannel heat exchanger to a compressor, each microchannel heat exchanger is shared by the compressors. Each microchannel heat exchanger is divided into sections by partitioning baffles such that each section handles refrigerant from a different compressor. Pipes are used to carry the refrigerant from one microchannel heat exchanger to another. These pipes overlap such that the microchannel heat exchangers are intertwined. In this manner, refrigerant from each compressor can flow through the microchannel heat exchanger at the front of the arrangement (e.g., the microchannel heat exchanger that is exposed to the most and/or coldest airflow). Additionally, even if a compressor is shut off, the airflow hitting the microchannel heat exchanger in the front of the arrangement would not be wasted and the face of the heat exchanger is actively used to transfer heat, which improves system efficiency. The cooling system will be described using FIGS. 1 through 9. Although this disclosure describes using the unconventional arrangement of microchannel heat exchangers in high side heat exchangers (e.g., condensers), this disclosure contemplates that the unconventional arrangement of microchannel heat exchangers can also be used in low side heat exchangers (e.g., evaporators).

FIG. 1 illustrates an example cooling system 100. As shown in FIG. 1, system 100 includes a high side heat exchanger 105, a low side heat exchanger 110, and compressors 115A and 115B. This disclosure contemplates cooling system 100 or any cooling system described herein including any number of high side heat exchangers, low side heat exchangers, and/or compressors. Generally, refrigerant is cycled through system 100 to cool a space proximate low side heat exchanger 110.

High side heat exchanger 105 removes heat from a refrigerant. When heat is removed from the refrigerant, the refrigerant is cooled. This disclosure contemplates high side heat exchanger 105 being operated as a condenser and/or a gas cooler. When operating as a condenser, high side heat exchanger 105 cools the refrigerant such that the state of the refrigerant changes from a gas to a liquid. When operating as a gas cooler, high side heat exchanger 105 cools gaseous refrigerant and the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building. This disclosure contemplates any suitable refrigerant (e.g., carbon dioxide, R-410A, low-GWP refrigerants, etc.) being used in any of the disclosed cooling systems.

Refrigerant flows to low side heat exchanger 110. When the refrigerant reaches low side heat exchanger 110, the refrigerant removes heat from air flowing around low side heat exchanger 110. As a result, that air is cooled. The cooled air may then be circulated such as, for example, by a fan, to cool a space, which may be a room of a building. As refrigerant passes through low side heat exchanger 110, the refrigerant may change from a liquid state or a two-phase liquid/vapor mixture to a gaseous state. This disclosure contemplates low side heat exchanger 110 being any suitable device, including a microchannel heat exchanger, for transferring heat to the refrigerant. For example, low side heat exchanger 110 may be an evaporator, a coil, an air-cooled tube and plate-fin type heat exchanger, a microchannel heat exchanger, or a water-cooled shell and tube-heat exchanger.

Refrigerant may flow from low side heat exchanger 110 to one or more of compressors 115A and 115B. This disclosure contemplates system 100 including any number of compressors 115. Compressors 115 may be configured to increase the pressure of the refrigerant. As a result, the heat in the refrigerant may become concentrated and the refrigerant may become a high pressure gas. Compressors 115 may then send the compressed refrigerant to high side heat exchanger 105. Compressors 115 may be variable speed compressors that operate at various speeds depending on the needs of system 100. For example, when the cooling demands of system 100 are great, compressors 115 may operate at a high speed. When the cooling demands of system 100 are low, compressors 115 may operate at a low speed. Additionally, compressors 115 may operate at different speeds depending on the demands of the system.

High side heat exchanger 105 and/or low side heat exchanger 110 may include a microchannel heat exchanger. Generally, a microchannel heat exchanger includes one or more tubes with one or more microchannels that act as conduits for the refrigerant. These microchannels effectively increase the heat transfer area of the refrigerant, which allows more heat to be transferred to or out of the refrigerant as the refrigerant flows through the microchannels. The details of a microchannel heat exchanger will be described using FIGS. 2A and 2B. For ease of discussion, it will be assumed that microchannel heat exchanger is implemented in high side heat exchanger 105 to transfer heat out of the refrigerant, but this disclosure contemplates that microchannel heat exchanger can be similarly implemented in low side heat exchanger 110 to transfer heat to the refrigerant.

Figure 2A:
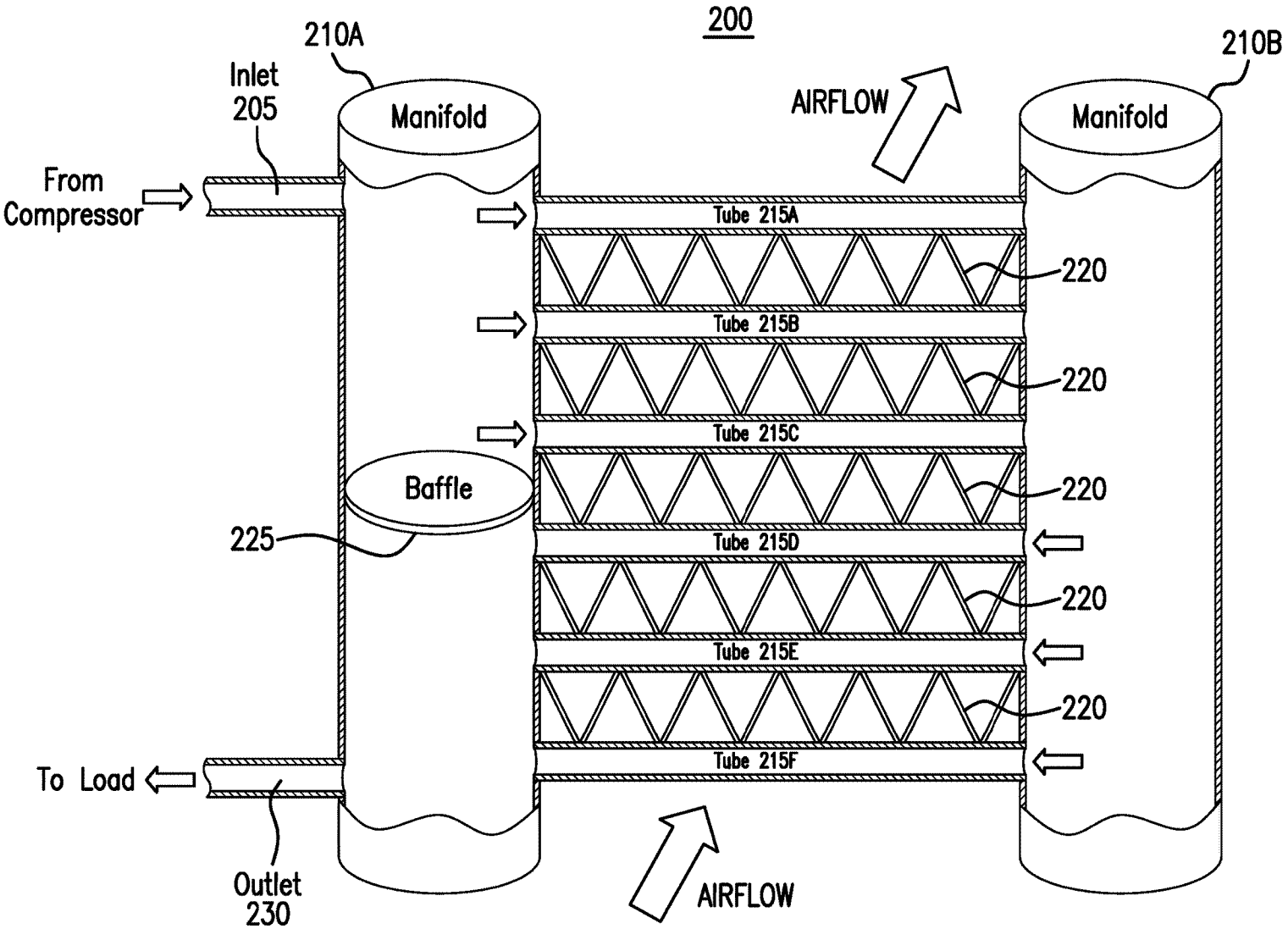
FIG. 2A illustrates an example microchannel heat exchanger.
Figure 2B:
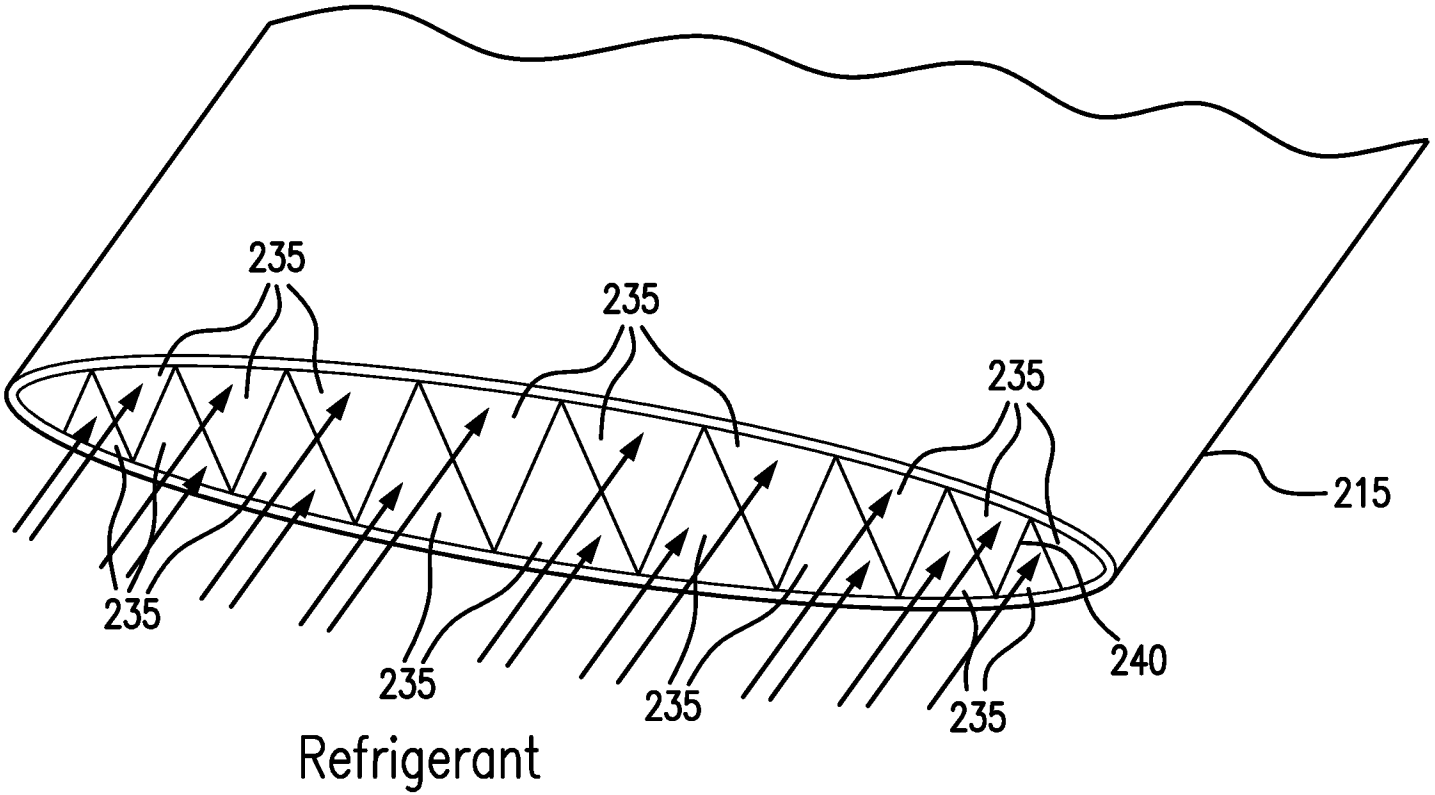
FIG. 2B illustrates a tube of an example microchannel heat exchanger.

FIGS. 2A and 2B illustrate an example microchannel heat exchanger 200. As seen in FIG. 2A, microchannel heat exchanger 200 includes an inlet 205, manifolds 210, tubes 215, fins 220, baffle 225, and outlet 230. Generally, refrigerant enters microchannel heat exchanger 200 through inlet 205 and passes through one or more tubes 215. Heat is transferred to or from the refrigerant and the refrigerant is directed away from microchannel heat exchanger 200 through outlet 230.

Inlet 205 receives a refrigerant. In the contemplated system where microchannel heat exchanger 200 is implemented in high side heat exchanger 105, inlet 205 receives refrigerant from a compressor 115. The refrigerant may be a hot gas. Inlet 205 directs the refrigerant into manifold 210A.

Manifold 210A is coupled to one or more tubes 215. In the illustrated example of FIG. 2A, manifold 210A is coupled to tubes 215A, 215B, 215C, 215D, 215E, and 215F. Manifold 210A includes a baffle 225 that isolates a top portion of manifold 210A from a bottom portion of manifold 210A. In this manner, baffle 225 prevents refrigerant from flowing through baffle 225 (i.e., from the top portion of manifold 210A directly to the bottom portion of manifold 210A). As a result, refrigerant from inlet 205 enters manifold 210A and is directed to tubes 215A, 215B, and 215C. Baffle 225 prevents the refrigerant from entering tubes 215D, 215E, and 215F from manifold 210A.

As the refrigerant flows through tubes 215A, 215B, and 215C, heat is transferred to or from the refrigerant. Fins 220 positioned between tubes 215 and coupled to tubes 215 transfer heat to or from the refrigerant in tubes 215 to the air surrounding fins 220. Air is moved across fins 220 to move the cooled or heated air surrounding fins 220. In this manner, heat is transferred to or removed from the refrigerant in tubes 215. Tubes 215A, 215B, and 215C direct the refrigerant to manifold 210B.

Manifold 210B receives the refrigerant from tubes 215A, 215B, and 215C. The refrigerant is then directed to tubes 215D, 215E, and 215F. Tubes 215D, 215E, and 215F direct the refrigerant back towards manifold 210A. As seen in FIG. 2A, additional fins are coupled to tubes 215D, 215E, and 215F. These fins 220 add or remove additional heat to or from the refrigerant in tubes 215D, 215E, and 215F. Air flow moves the air surrounding fins 220 and the refrigerant in tubes 215D, 215E, and 215F is further heated and/or cooled.

When the refrigerant returns to manifold 210A through tubes 215D, 215E, and 215F, the refrigerant is directed to outlet 230. Outlet 230 directs the refrigerant away from microchannel heat exchanger 200. In the example where microchannel heat exchanger 200 is implemented in a high side heat exchanger 105, outlet 230 directs the refrigerant to low side heat exchanger 210.

As discussed above, microchannel heat exchanger 200 may be implemented in low side heat exchanger 110. In that implementation, inlet 205 receives refrigerant from high side heat exchanger 105. The refrigerant absorbs heat from the air surrounding fins 220 as the refrigerant travels through tubes 215. As a result, the refrigerant is heated. The refrigerant is then directed through outlet 230 towards compressor 115.

FIG. 2B illustrates an example tube 215 of microchannel heat exchanger 200. As seen in FIG. 2B, tube 215 includes one or more microchannels 235. Tube 215 is sectioned using partition 240. Partition 240 sections off each microchannel 235 of tubes 215. Refrigerant enters each microchannel 235 and flows through tube 215. As seen in FIG. 2B, each microchannel 235 is bounded by an exterior surface of tube 215. As a result, the refrigerant flowing through a microchannel 235 experiences heat transfer through the exterior surface of tube 215. Heat transfer is improved compared to sending refrigerant through one large coil or tube, because the microchannels 235 of the various tubes 215 of the microchannel heat exchanger 200 effectively increase the heat transfer area for the refrigerant.

Figure 3:
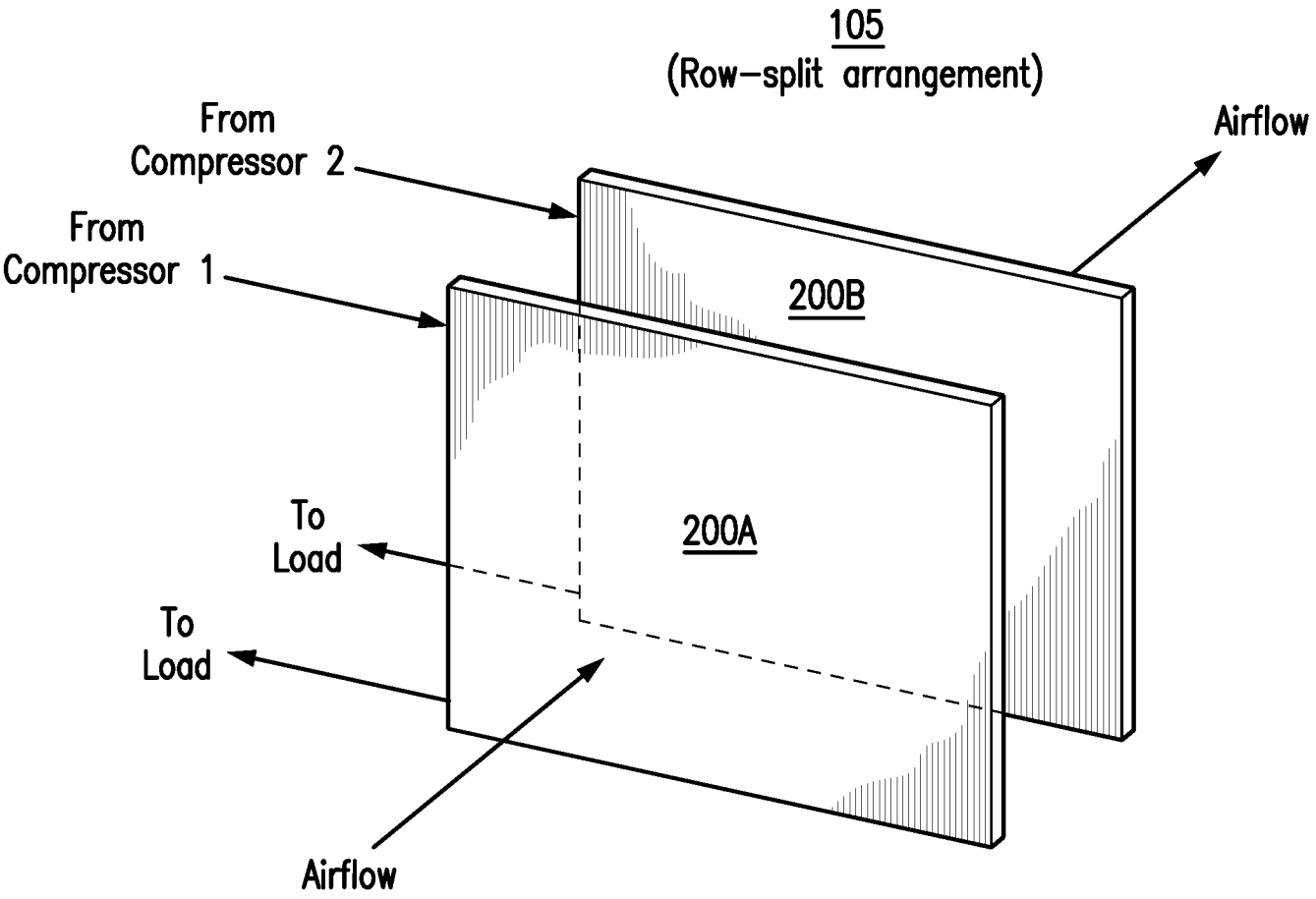
FIG. 3 illustrates an example row-split arrangement of microchannel heat exchangers.

FIG. 3 illustrates an example row-split arrangement of microchannel heat exchangers 200 in high side heat exchanger 105. System 100 includes two compressors 115. In certain installations, each compressor 115 directs refrigerant to a separate, dedicated microchannel heat exchanger 200 in high side heat exchanger 105. As seen in FIG. 3, high side heat exchanger 105 includes a microchannel heat exchanger 200A and a microchannel heat exchanger 200B.

Refrigerant from compressor 1 is directed into microchannel heat exchanger 200A. Microchannel heat exchanger 200A removes heat from that refrigerant and directs the refrigerant to low side heat exchanger 110. Conversely, refrigerant from compressor 2 is directed to microchannel heat exchanger 200B. Microchannel heat exchanger 200B removes heat from that refrigerant and directs that refrigerant to low side heat exchanger 110.

As seen in FIG. 3, microchannel heat exchanger 200A is positioned in front of microchannel heat exchanger 200B along the direction of air flow. As a result, air hits microchannel heat exchanger 200A before hitting microchannel heat exchanger 200B. Thus, microchannel heat exchanger 200A removes more heat from refrigerant than microchannel heat exchanger 200B, which results in uneven heat removal between the two microchannel heat exchangers 200. Additionally, if the compressor 115 for microchannel heat exchanger 200A is shut off, then air would unnecessarily hit microchannel heat exchanger 200A. This disclosure contemplates an unconventional arrangement for microchannel heat exchangers 200 that addresses one or more of these issues. That arrangement and its operation and assembly is described using FIGS. 4-10D.

Figure 4:
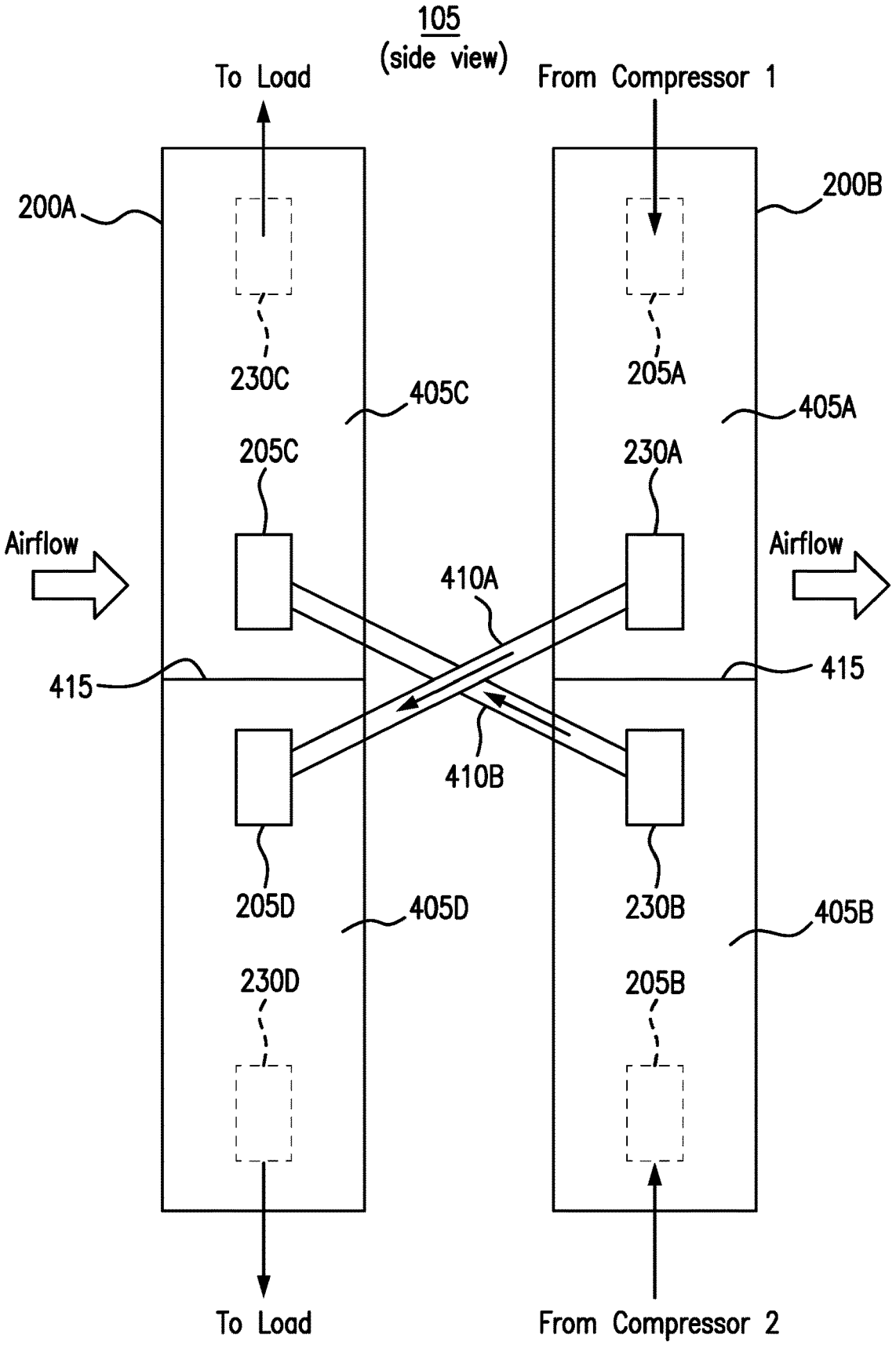
FIG. 4 illustrates a side view of an example arrangement of microchannel heat exchangers.

FIG. 4 illustrates a sideview of an example arrangement of microchannel heat exchangers 200 in high side heat exchanger 105. As seen in FIG. 4, high side heat exchanger 105 includes microchannel heat exchanger 200A and microchannel heat exchanger 200B. Microchannel heat exchanger 200A is positioned in front of microchannel heat exchanger 200B along a direction of airflow. Generally, microchannel heat exchangers 200A and 200B are configured to receive refrigerant from two different compressors 115 in cooling system 100. As a result, microchannel heat exchangers 200A and 200B each remove heat from refrigerant from two different compressors 115.

Microchannel heat exchanger 200B includes a portion 405A and a portion 405B. Portions 405A and 405B are isolated from one another through partition 415. Partition 415 may be a baffle. Portion 405A is positioned vertically higher than portion 405B. Portion 405A includes an inlet 205A that receives refrigerant from a first compressor 115. Portion 405B includes an inlet 205B that receives refrigerant from a second compressor 115. Inlets 205A and 205B are illustrated using dashed lines to indicate that inlets 205A and 205B are coupled to a manifold that is in the back of the drawing. Refrigerant that enters microchannel heat exchanger 200B through inlet 205A is directed through tubes 215 to outlet 230A. Likewise, refrigerant that enters microchannel heat exchanger 200B through inlet 205B is directed through tubes 215 to outlet 230B. Outlets 230A and 230B are drawn using solid lines to indicate that outlets 230A and 230B are coupled to a manifold at the front of the drawings. As seen in FIG. 4, inlet 205A is positioned vertically higher than outlet 230A, outlet 230B, and inlet 205B. Outlet 230A is positioned vertically higher than outlet 230B and inlet 205B. Outlet 230B is positioned vertically higher than inlet 205B.

Pipes 410A and 410B are coupled to microchannel heat exchangers 200A and 200B. Pipes 410A and 410B may be made from any suitable material such as, for example, copper. Pipes 410A and 410B may be coupled to microchannel heat exchangers 200A and 200B using any suitable method, such as for example, brazing. Pipes 410A and 410B direct refrigerant from the outlets 230 of microchannel heat exchanger 200B to the inlets 205 of microchannel heat exchanger 200A. In the example of FIG. 4, pipe 410A directs refrigerant from outlet 230A to inlet 205D of microchannel heat exchanger 200A. Pipe 410B directs refrigerant from outlet 230B to inlet 205C of microchannel heat exchanger 200A. Pipes 410A and 410B crisscross, such that a portion of pipe 410A overlaps a portion of pipe 410B between microchannel heat exchanger 200A and microchannel heat exchanger 200B.

Microchannel heat exchanger 200A includes a first portion 405C and a second portion 405D. Portion 405C is positioned vertically higher than portion 405D. Portions 405C and 405D are isolated from one another by partition 415, which may be a baffle. Portion 405C includes an inlet 205C and an outlet 230C. Portion 405D includes an inlet 205D and an outlet 230D. Inlets 205C and 205D are illustrated using solid lines to indicate that inlets 205C and 205D are coupled to a manifold that is in the front of the drawing. Outlets 230C and 230D are drawn using dashed lines to indicate that outlets 230C and 230D are coupled to a manifold at the back of the drawings. As seen in FIG. 4, outlet 230C is positioned vertically higher than inlet 205C, inlet 205D, and outlet 230D. Inlet 205C is positioned vertically higher than inlet 205D and outlet 230D. Inlet 205D is positioned vertically higher than outlet 230D.

Inlet 205C receives refrigerant from pipe 410B. That refrigerant is directed through tubes 215 towards outlet 230C. Likewise, inlet 205D receives refrigerant from pipe 410A. That refrigerant is directed through tubes 215 towards outlet 230D. Outlet 230A is positioned vertically higher than inlet 205D. Inlet 205C is positioned vertically higher than outlet 230B.

Figure 5:
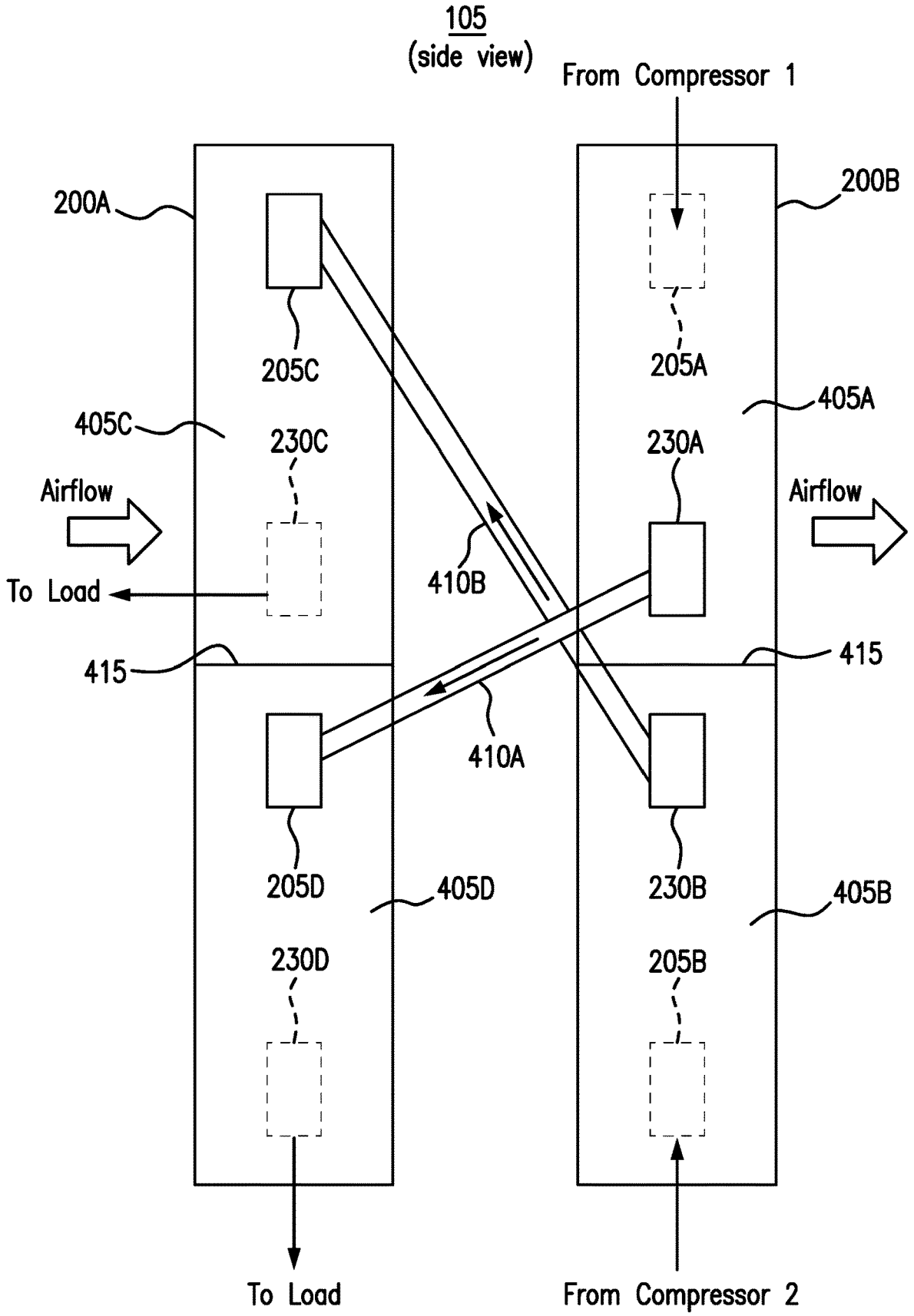
FIG. 5 illustrates a side view of an example arrangement of microchannel heat exchangers.

FIG. 5 illustrates a sideview of an example arrangement of microchannel heat exchangers 200 and high side heat exchanger 105. Similar to FIG. 4, microchannel heat exchanger 200A is positioned in front of microchannel heat exchanger 200B along a direction of air flow. A difference between the arrangement of FIG. 5 and the arrangement of FIG. 4 is that inlet 205C is positioned vertically higher than outlet 230C. As a result, pipe 410B reaches higher in the arrangement of FIG. 5 than in the arrangement of FIG. 4. Microchannel heat exchanger 200A is arranged more symmetrically in FIG. 5 than in FIG. 4. For example, refrigerant enters microchannel heat exchanger 200A through inlets 205C and 205D at the top of portions 405C and 405D. The refrigerant leaves microchannel heat exchanger 200A through outlets 230C and 230D at the bottom of portions 405C and 405D. In this manner, the direction of flow of refrigerant through portions 405C and 405D are the same, which in some instances, improves the heat transfer to or from the refrigerant. As seen in FIG. 5, inlet 205A is positioned vertically higher than outlet 230A, outlet 230B, and inlet 205B. Outlet 230A is positioned vertically higher than outlet 230B and inlet 205B. Outlet 230B is positioned vertically higher than inlet 205B. Inlet 205C is positioned vertically higher than outlet 230C, inlet 205D, and outlet 230D. Outlet 230C is positioned vertically higher than inlet 205D and outlet 230D. Inlet 205D is positioned vertically higher than outlet 230D. Inlet 205C is positioned higher than outlet 230A and outlet 230B. Outlet 230A is positioned vertically higher than inlet 205D.

Although FIGS. 4 and 5 illustrate microchannel heat exchangers 200A and 200B being aligned vertically, this disclosure contemplates that microchannel heat exchangers 200A and 200B may be offset from each other in any direction. For example microchannel heat exchangers 200A and 200B may be different heights. As another example, microchannel heat exchangers 200A and 200B may be staggered such that one of microchannel heat exchangers 200A and 200B extends vertically beyond the other microchannel heat exchanger 200A or 200B. In other words, the top or bottom surface of one of microchannel heat exchangers 200A and 200B extends beyond the top or bottom surface of the other microchannel heat exchangers 200A or 200B.

Although FIGS. 4 and 5 illustrate microchannel heat exchanger 200A being positioned in front of microchannel heat exchanger 200B in a direction of airflow, it is contemplated that microchannel heat exchanger 200B can be positioned in front of microchannel heat exchanger 200A in the direction of airflow. Additionally, although FIGS. 4 and 5 illustrate pipes 410A and 410B crossing such that pipe 410B is closer to microchannel heat exchangers 200A and 200B at the point of crossing, it is contemplated that pipes 410A and 410 can cross such that pipe 410A is closer to microchannel heat exchangers 200A and 200B at the point of crossing.

Figure 6:
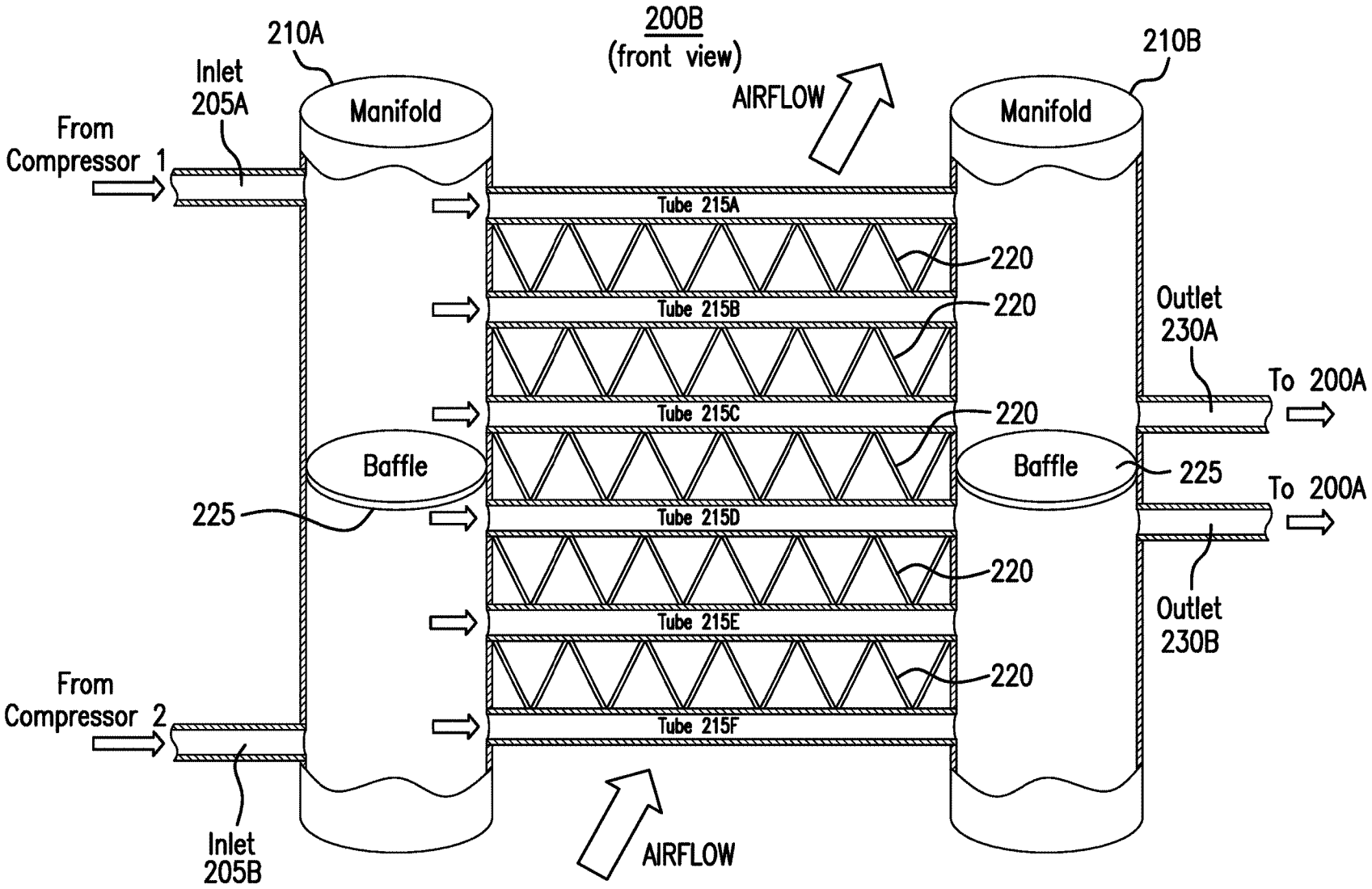
FIG. 6 illustrates a front view of an example microchannel heat exchanger.

FIG. 6 illustrates a front view of microchannel heat exchanger 200B. This front view of microchannel heat exchanger 200B corresponds to either of the arrangements of FIG. 4 or FIG. 5. Generally, microchannel heat exchanger 200B removes heat from refrigerant from the compressors 115 in system 100. As seen in FIG. 6, microchannel heat exchanger 200B includes a manifold 210A. Two inlets 205A and 205B are coupled to manifold 210A. Refrigerant from a first compressor 115 enters through inlet 205A. Refrigerant from a second compressor 115 enters through inlet 205B. The refrigerant from the first compressor enters a top portion of manifold 210A and the refrigerant from the second compressor 115 enters a bottom portion of manifold 210A. Baffle 225 prevents the refrigerant from the top portion of manifold 210A from entering the bottom portion of manifold 210A, and vice versa.

The refrigerant is directed through tubes 215. In the example of FIG. 6, refrigerant from the first compressor is directed through tubes 215A, 215B, and 215C. Refrigerant from the second compressor is directed through tubes 215D, 215E, and 215F. Heat is removed from the refrigerant as the refrigerant flows through tubes 215 by fins 220. Air is moved over fins 220 to remove the heat collected by fins 220.

The refrigerant flows through tubes 215 to manifold 210B. Refrigerant from tubes 215A, 215B, and 215C enters a top portion of manifold 210B. Refrigerant from tubes 215D, 215E, and 215F enter a bottom portion of manifold 210B. Baffle 225 isolates the top portion of manifold 210B from the bottom portion of 210B such that the refrigerant in the top portion does not flow to the bottom portion of manifold 210B, and vice versa.

Refrigerant in the top portion of manifold 210B is directed away from microchannel heat exchanger 200B through outlet 230A. Refrigerant in the bottom portion of manifold 210B is directed away from microchannel heat exchanger 200B through outlet 230B. Each outlet 230 is coupled to a pipe 410 that directs the refrigerant to another microchannel heat exchanger 200A. A portion of each pipe 410 overlaps a portion of the other pipe 410 in an area between the two microchannel heat exchangers 200A and 200B.

As seen in FIG. 6, inlet 205A is positioned vertically higher than outlet 230A, outlet 230B, and inlet 205B. Outlet 230A is positioned vertically higher than outlet 230B and inlet 205B. Outlet 230B is positioned vertically higher than inlet 205B.

Figure 7A:
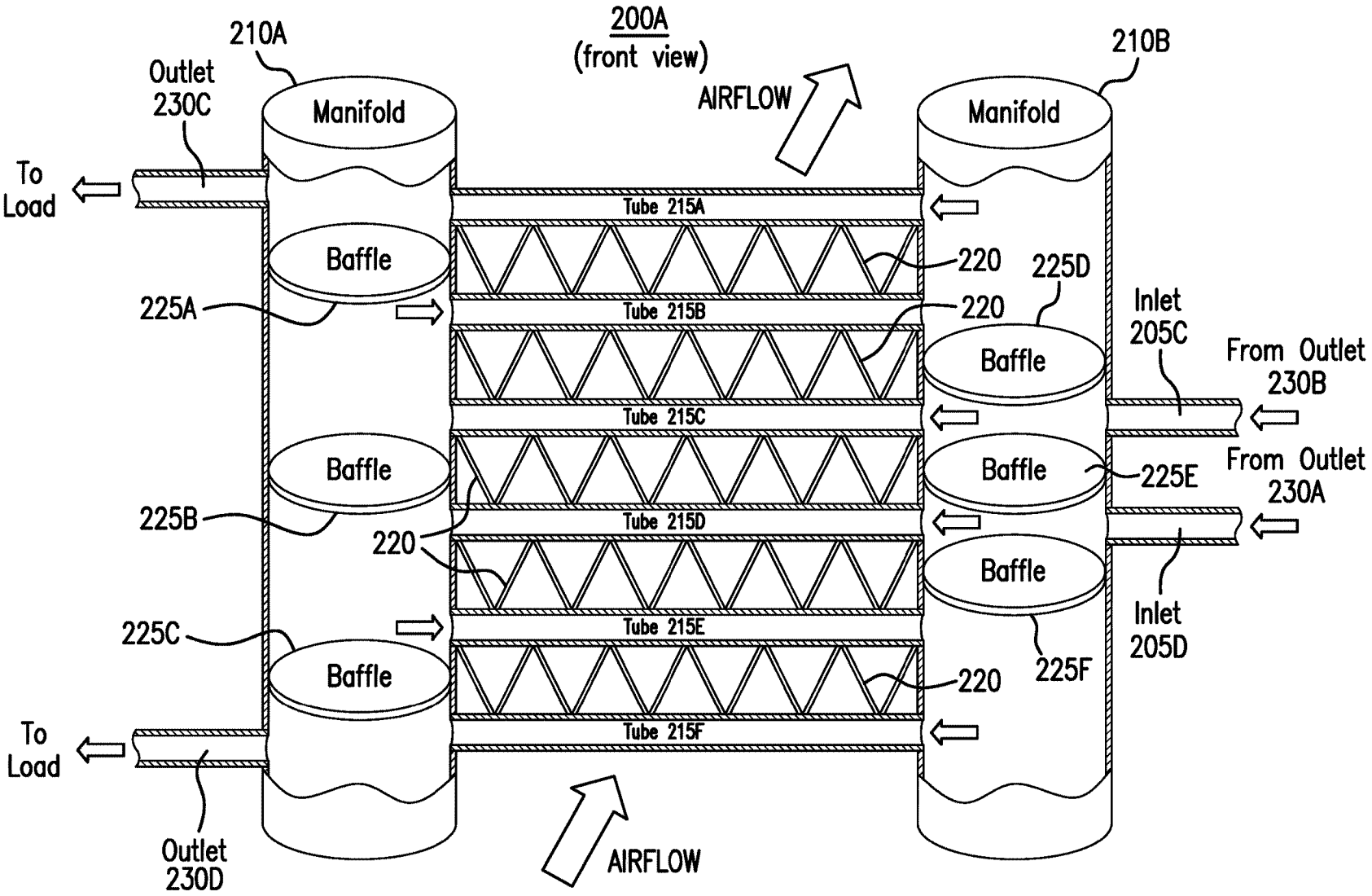
FIG. 7A illustrates a front view of an example microchannel heat exchanger.

FIG. 7A illustrates a front view of a microchannel heat exchanger 200A. This arrangement of microchannel heat exchanger 200A corresponds with the arrangement in FIG. 4. The configuration of microchannel heat exchanger 200A and microchannel heat exchanger 200B (as shown in FIGS. 4, 6, and 7A) allow microchannel heat exchangers 200A and 200B to each remove heat from refrigerant from two different compressors. Thus, airflow is not wasted even if one of the compressors were shut off.

Microchannel heat exchanger 200A includes an inlet 205C and an inlet 205D. Inlet 205C receives refrigerant from outlet 230B of microchannel heat exchanger 200B (via a pipe 410). Inlet 205D received refrigerant from outlet 230A of microchannel heat exchanger 200B (via a pipe 410). Refrigerant entering through inlet 205C is directed to a portion of manifold 210B. Refrigerant entering through inlet 205D is directed to a portion of manifold 210B.

Manifold 210B is separated into various sections using baffles 225D, 225E, and 225F. These baffles 225D, 225E, and 225F prevent refrigerant from one section from flowing directly (i.e., through baffle 225D, 225E, and 225F) into another section. Baffles 225D and 225E create a section that receives refrigerant from inlet 205C. Baffles 225E and 225F create a section that receives refrigerant from inlet 205D. Refrigerant from inlet 205C is directed through tube 215C towards manifold 210A. Refrigerant from inlet 205D is directed through tube 215D towards manifold 210A. Heat is removed from the refrigerant as it travels through tubes 215C and 215D.

Manifold 210A is sectioned into various sections using baffles 225A, 225B, and 225C. These baffles 225A, 225B, and 225C prevent refrigerant from one section from flowing directly (i.e., through baffle 225A, 225B, and 225C) into another section. Baffles 225A and 225B create a section that receives the refrigerant from tube 215C. Baffles 225B and 225C create a section that receives the refrigerant from tube 215D. Refrigerant from tube 215C is directed to tube 215B and back towards manifold 210B. Refrigerant from tube 215D is directed to tube 215E back towards manifold 210B. Heat is removed from the refrigerant as it travels through tubes 215B and 215E.

Refrigerant from tube 215B enters manifold 210B into a section created by baffle 225D and is directed to tube 215A. Refrigerant from tube 215E is directed to manifold 210B into a section created by baffle 225F and is directed to tube 215F. Refrigerant in tube 215A flows back towards manifold 210A. Refrigerant in tube 215F is directed back towards manifold 210A. Heat is removed from the refrigerant as it flows through tubes 215A and 215F.

Manifold 210A directs the refrigerant from tube 215A to outlet 230C and towards low side heat exchanger 110. Manifold 210A directs the refrigerant from tube 215F to outlet 230D and to low side heat exchanger 110. In this manner, microchannel heat exchanger 200A removes heat from refrigerant from both compressors 115 in system 100.

As seen in FIG. 7A, outlet 230C is positioned vertically higher than inlet 205C, inlet 205D, and outlet 230D. Inlet 205C is positioned vertically higher than inlet 205D and outlet 230D. Inlet 205D is positioned vertically higher than outlet 230D.

Figure 7B:
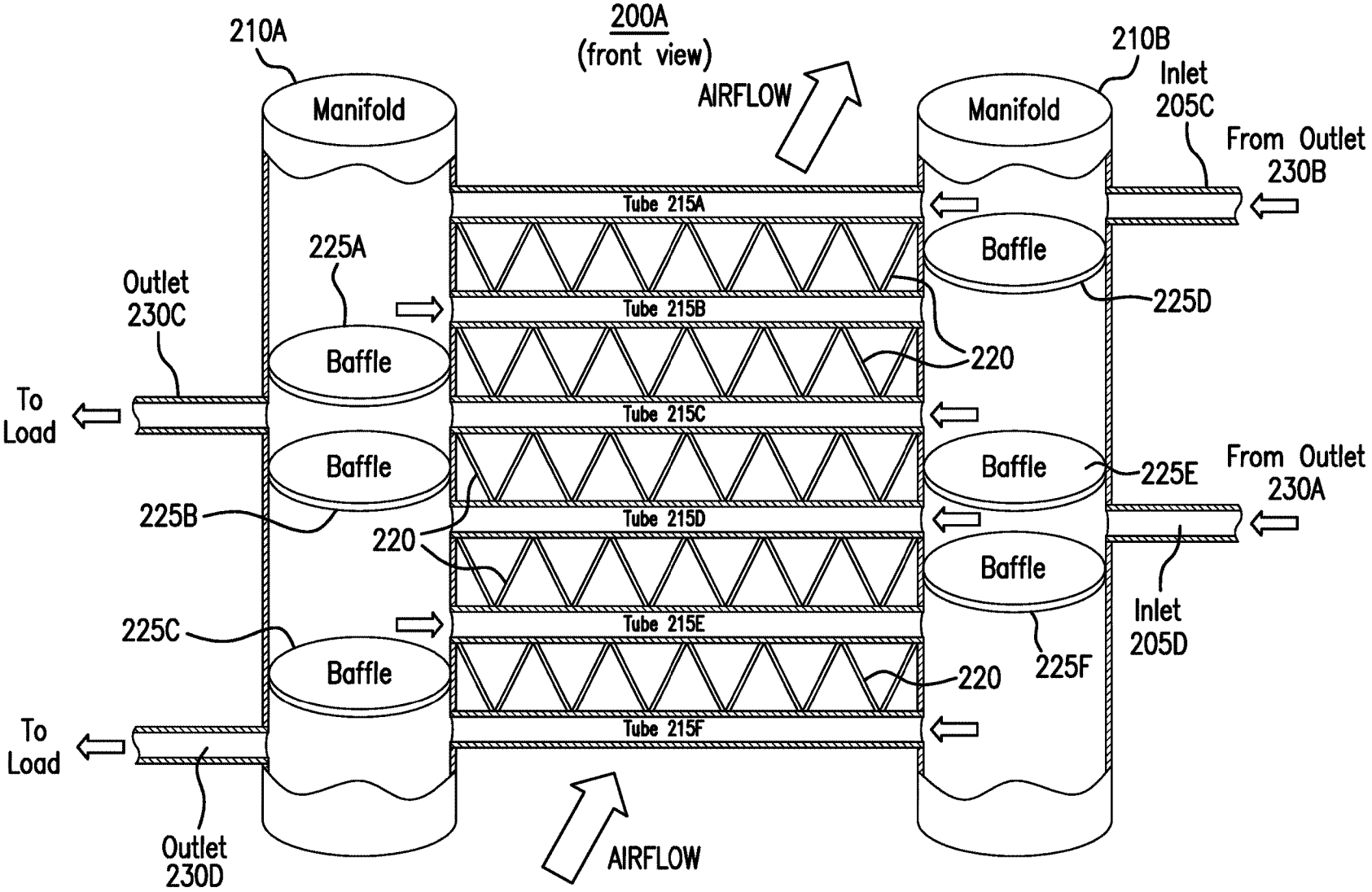
FIG. 7B illustrates a front view of an example microchannel heat exchanger.

FIG. 7B illustrates a front view of microchannel heat exchanger 200A. This configuration of microchannel heat exchanger 200A corresponds to the arrangement shown in FIG. 5. Although the configuration in FIG. 7B is different from the configuration of FIG. 7A, the general operation of the configuration of FIG. 7B is similar to the operation of the configuration of FIG. 7A. As described previously, a difference between the two configurations is that inlet 205C is positioned vertically higher than outlet 230C, inlet 205D, and outlet 230D in the configuration of FIG. 7B. The configuration of microchannel heat exchanger 200A and microchannel heat exchanger 200B (as shown in FIGS. 5, 6, and 7B) allow microchannel heat exchangers 200A and 200B to each remove heat from refrigerant from two different compressors. Thus, airflow is not wasted even if one of the compressors were shut off.

Refrigerant from outlet 230B enters manifold 210B through inlet 205C (via a pipe 410). Refrigerant from outlet 230A enters manifold 210B through inlet 205D (via a pipe 410). Refrigerant from inlet 205C is directed to tube 215A. Refrigerant from inlet 205D is directed to tube 215D.

Tube 215A directs the refrigerant to manifold 210A. Heat is removed from the refrigerant as it flows through tube 215A. Tube 215D directs refrigerant to manifold 210A. Heat is removed from the refrigerant as the refrigerant flows through tube 215D. Manifold 210A directs refrigerant from tube 215A to tube 215B. Manifold 210A directs refrigerant from tube 215D to tube 215E. Heat is removed from the refrigerant as it flows through tubes 215B and 215E. Tubes 215B and 215E direct the refrigerant back towards manifold 210B.

Manifold 210B directs refrigerant from tube 215B to tube 215C. Manifold 210B directs refrigerant from tube 215E to tube 215F. Tube 215C directs refrigerant back towards manifold 210A. Tube 215F directs refrigerant back towards manifold 210A. Heat is removed from the refrigerant as the refrigerant flows through tubes 215C and 215F.

Manifold 210A directs refrigerant from tube 215C away from microchannel heat exchanger 200A through outlet 230C to low side heat exchanger 110. Manifold 210A directs refrigerant from tube 215F away from microchannel heat exchanger 200A through outlet 230D to low side heat exchanger 110. As discussed previously, the arrangement of microchannel heat exchanger 200A in FIG. 7B allows refrigerant in a top portion of microchannel heat exchanger 200A to flow in the same direction as refrigerant in a bottom portion of microchannel heat exchanger 200A. In certain instances, this direction of flow may improve heat transfer in microchannel heat exchanger 200A.

As seen in FIG. 7B, inlet 205C is positioned vertically higher than outlet 230C, inlet 205D, and outlet 230D. Outlet 230C is positioned vertically higher than inlet 205D and outlet 230D. Inlet 205D is positioned vertically higher than outlet 230D.

In certain embodiments, microchannel heat exchangers 200A and 200B may have fewer tubes 215 and larger fins 220 relative to conventional designs of microchannel heat exchangers. As a result, the cost and weight of each microchannel heat exchanger 200A or 200B are reduced relative to conventional designs.

Although FIGS. 6, 7A, and 7B illustrate microchannel heat exchangers 200A and 200B including a certain number of baffles 225 configured such that refrigerant passes through microchannel heat exchangers 200A and 200B a certain number of times before reaching an outlet 230, it is contemplated that microchannel heat exchangers 200A and 200B can include any suitable number of baffles 225 configured to provide any suitable number of passes through microchannel heat exchangers 200A and 200B before reaching an outlet 230. Additionally, although microchannel heat exchangers 200A and 200B are shown as rectangular in shape, it is contemplated that microchannel heat exchangers 200A and 200B can be configured to be any suitable shape. For example, microchannel heat exchangers 200A and 200B can be bent into a curved shape.

Figure 8:
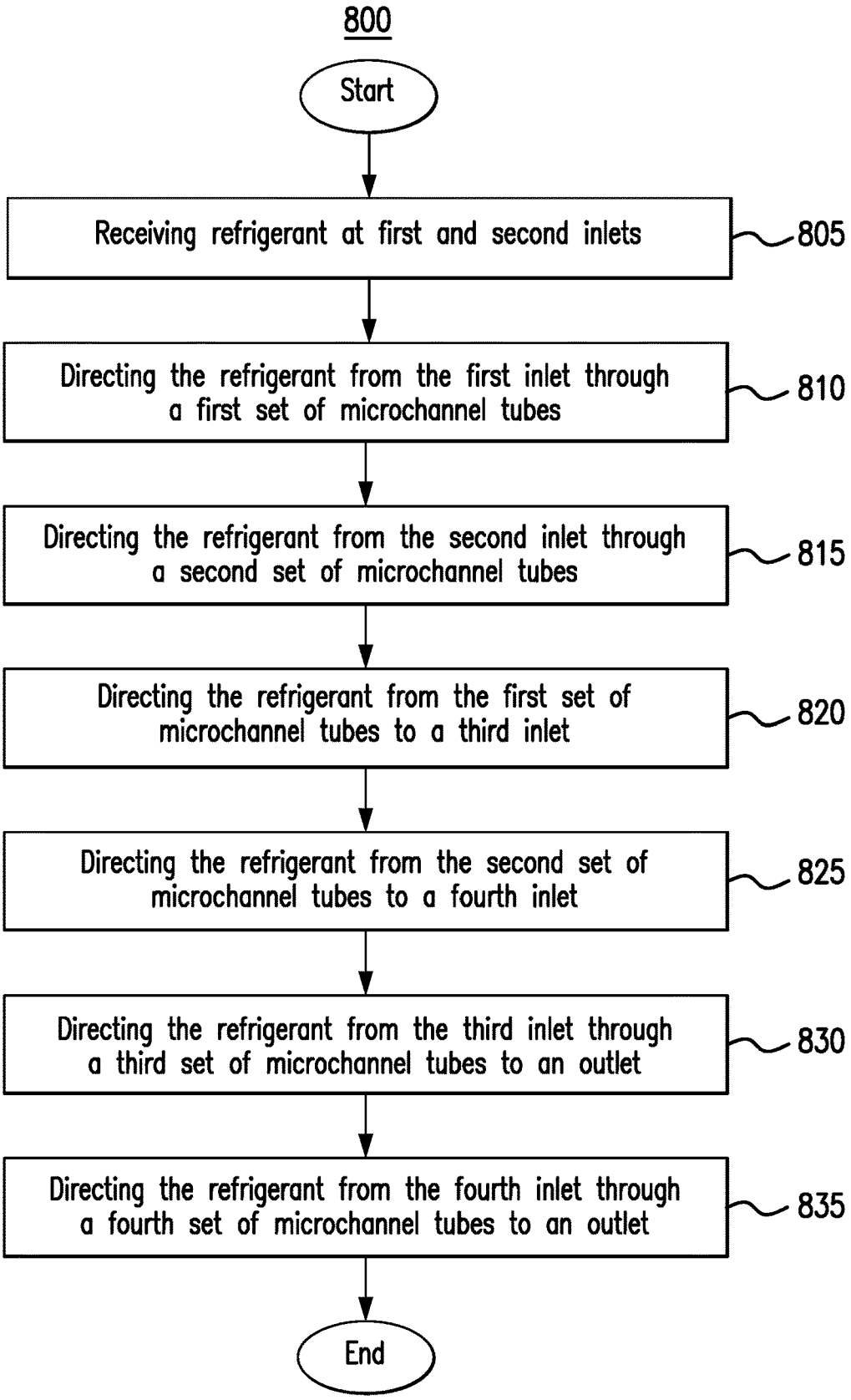
FIG. 8 is a flowchart illustrating a method of operating example microchannel heat exchangers.

FIG. 8 is a flow chart illustrating a method of operating example microchannel heat exchangers. In particular embodiments, various components of cooling system 100 perform the steps of method 800. As a result of performing method 800, microchannel heat exchangers can each remove heat from refrigerant from two different compressors in certain embodiments.

In step 805, the refrigerant is received at first and second inlets of a first microchannel heat exchanger. The refrigerant from the first inlet is directed through a first set of microchannel tubes of the first microchannel heat exchanger in step 810. In step 815, the refrigerant from the second inlet is directed through a second set of microchannel tubes of the first microchannel heat exchanger. The refrigerant from the first set of microchannel tubes is directed through a third inlet of a second microchannel heat exchanger in step 820. In step 825, the refrigerant from the second set of microchannel tubes is directed through a fourth inlet of the second microchannel heat exchanger. The refrigerant from the third inlet is directed through a third set of microchannel tubes of the second microchannel heat exchanger to an outlet in step 830. In step 835, the refrigerant from the fourth inlet is directed through a fourth set of microchannel tubes of the second microchannel heat exchanger to an outlet.

Figure 9:
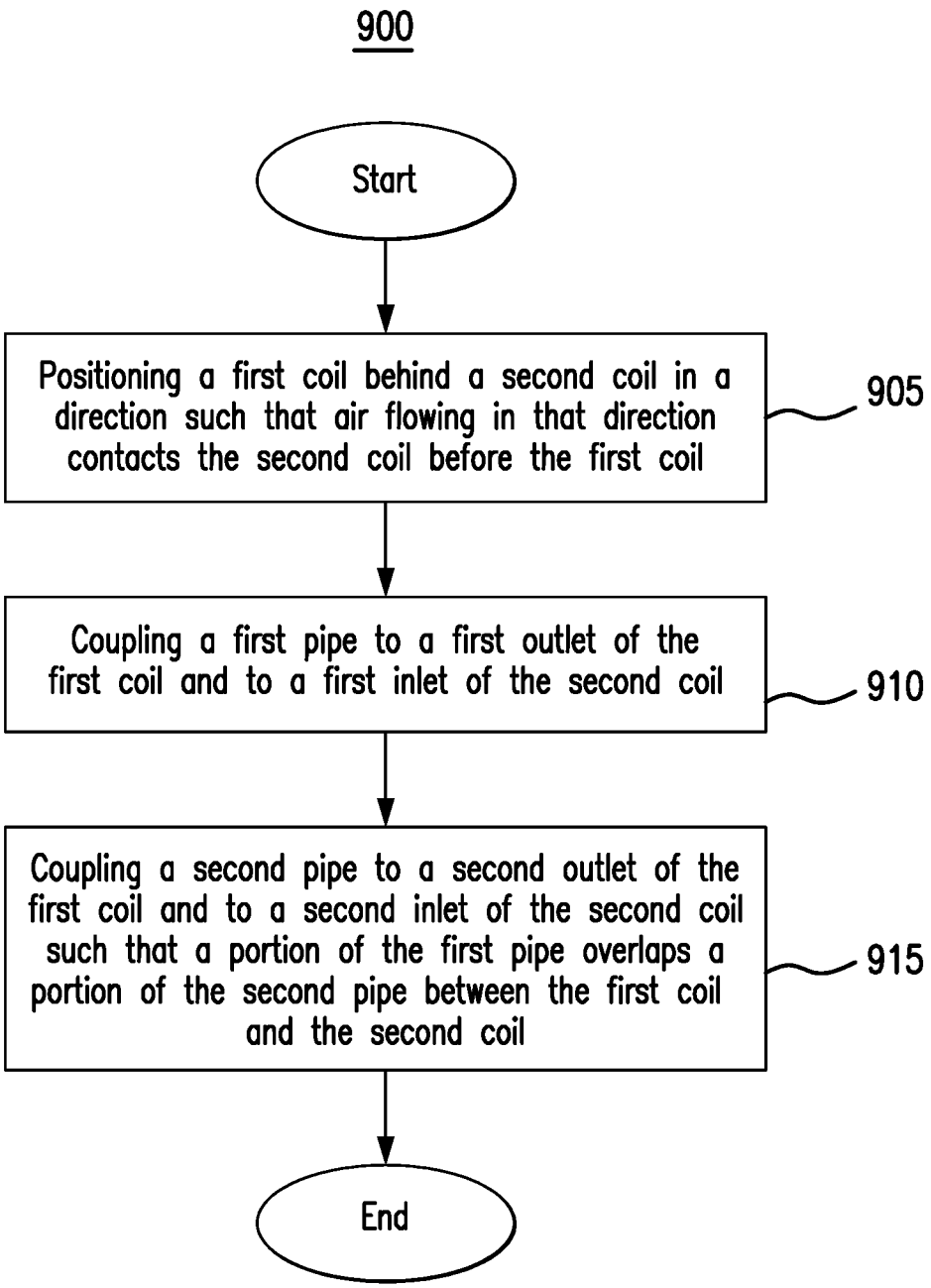
FIG. 9 is a flowchart illustrating a method of assembling example microchannel heat exchangers.

FIG. 9 is a flow chart illustrating a method 900 of assembling an example microchannel heat exchanger. An assembler may perform the steps of method 900. In step 905, a first coil (e.g., a coil of a first microchannel heat exchanger) is positioned behind a second coil (e.g., a coil of a second microchannel heat exchanger) in a direction such that air flowing in that direction contacts the second coil before the first coil. In step 910, a first pipe is coupled to a first outlet of the first coil and to a first inlet of the second coil. The first pipe may be a copper pipe that is coupled through brazing. In step 915, a second pipe is coupled to a second outlet of the first coil into a second inlet of the second coil such that a portion of the first pipe overlaps a portion of the second pipe between the first coil and the second coil. The second pipe may be a copper pipe that is coupled through brazing.

Modifications, additions, or omissions may be made to methods 800 and 900 depicted in FIGS. 8 and 9. Methods 800 and 900 may include more, fewer, or other steps. For example, steps may be performed in parallel or in any suitable order. While discussed as system 100 (or components thereof) or an assembler performing the steps, any suitable component of system 100 or any suitable number of assemblers may perform one or more steps of the methods 800 and 900.

Figure 10A:
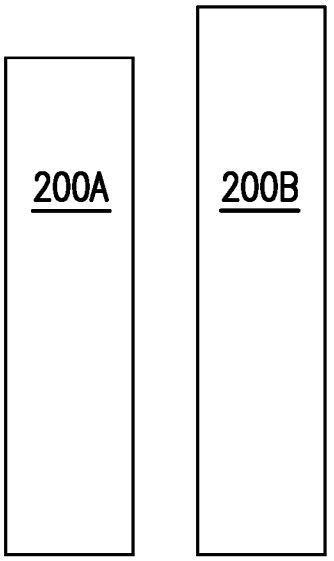
FIGS. 10A-10D illustrate configurations of example microchannel heat exchangers.
Figure 10B:
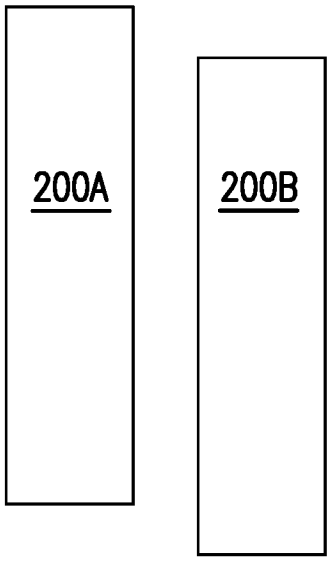
Figure 10C:
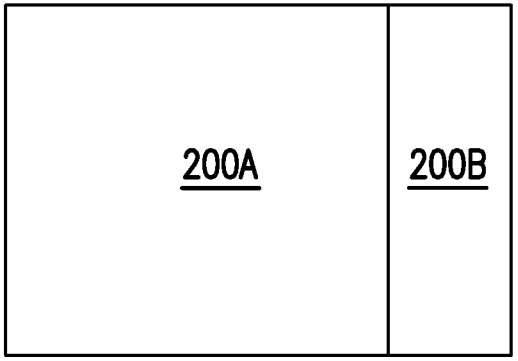
Figure 10D:
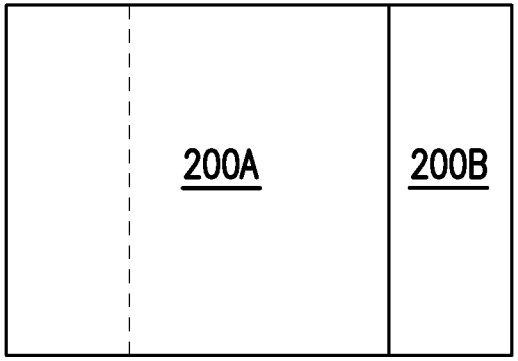

FIGS. 10A-10D illustrate arrangements of microchannel heat exchangers 200A and 200B. Although FIGS. 4 and 5 illustrate microchannel heat exchangers 200A and 200B being aligned, this disclosure contemplates that microchannel heat exchangers 200A and 200B may be offset from each other in any direction as shown in FIGS. 10A-10D. For example microchannel heat exchangers 200A and 200B may be different heights as shown in FIG. 10A. As another example, microchannel heat exchangers 200A and 200B may be staggered vertically as shown in FIG. 10B. In other words, the top or bottom surface of one of microchannel heat exchangers 200A and 200B may extend beyond the top or bottom surface of the other microchannel heat exchanger 200A or 200B. As another example, microchannel heat exchangers 200A and 200B may be different lengths as shown in FIG. 10C. Furthermore, microchannel heat exchangers 200A and 200B may be staggered horizontally from one another such that a side surface of microchannel heat exchangers 200A and 200B extends beyond the side surface of the other microchannel heat exchanger 200A or 200B. This disclosure contemplates that microchannel heat exchangers 200A and 200B may be configured to be of different dimensions and staggered (i.e., microchannel heat exchangers 200A and 200B may be configured according to the one or more of FIGS. 10A-10D). For example, microchannel heat exchangers may be staggered vertically/horizontally and be of different heights and lengths.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the compressor, the refrigerant from the low side heat exchanger, the refrigerant from the high side heat exchanger, etc.). When such terminology is used, this disclosure is not limiting the described refrigerant to being directly from the particular component. This disclosure contemplates refrigerant being from a particular component (e.g., the high side heat exchanger) even though there may be other intervening components between the particular component and the destination of the refrigerant.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a first microchannel heat exchanger configured to receive a refrigerant, the first microchannel heat exchanger comprising:

a first inlet configured to receive the refrigerant;

a second inlet configured to receive the refrigerant;

a first tube comprising first microchannels;

a second tube comprising second microchannels;

a first outlet, the refrigerant received by the first inlet is directed through the first microchannels of the first tube to the first outlet;

a second outlet, the refrigerant received by the second inlet is directed through the second microchannels of the second tube to the second outlet;

a first partition configured to prevent the refrigerant received by the first inlet from flowing to the second tube; and a second partition configured to prevent the refrigerant directed through the first tube from flowing to the second outlet;

a first pipe configured to receive the refrigerant from the first outlet;

a second pipe configured to receive the refrigerant from the second outlet, wherein the first pipe is disposed to crisscross the second pipe, wherein a portion of the first pipe overlaps a portion of the second pipe between the first microchannel heat exchanger and the second microchannel heat exchanger; and a second microchannel heat exchanger comprising:

a third inlet configured to receive the refrigerant through the second pipe, wherein the second pipe couples the second outlet to the third inlet;

a fourth inlet configured to receive the refrigerant through the first pipe, wherein the first pipe couples the first outlet to the fourth inlet;

a third tube comprising third microchannels;

a fourth tube comprising fourth microchannels;

a third outlet, the refrigerant received by the third inlet is directed through the third microchannels of the third tube towards the third outlet;

a fourth outlet, the refrigerant received by the fourth inlet is directed through the fourth microchannels of the fourth tube towards the fourth outlet;

a third partition configured to prevent the refrigerant received by the third inlet from flowing to the fourth tube; and a fourth partition configured to prevent the refrigerant directed through the third tube from flowing to the fourth outlet;

wherein the first microchannel heat exchanger is positioned behind the second microchannel heat exchanger along a first direction such that air flowing in the first direction contacts the second microchannel heat exchanger before the first microchannel heat exchanger.

2. The apparatus of claim 1, wherein the fourth outlet is positioned vertically higher than the fourth inlet.

3. The apparatus of claim 1, wherein the fourth outlet is positioned vertically lower than the fourth inlet.

4. The apparatus of claim 1, wherein the first microchannel heat exchanger is staggered from the second microchannel heat exchanger such that the first microchannel heat exchanger extends vertically beyond the second microchannel heat exchanger.

5. The apparatus of claim 1, wherein the first microchannel heat exchanger is a different length than the second microchannel heat exchanger in a second direction lateral to the first direction.

6. The apparatus of claim 1, wherein the first outlet is positioned vertically higher than the third inlet and the second outlet is positioned vertically lower than the fourth inlet.

7. The apparatus of claim 1, wherein the first microchannel heat exchanger and the second microchannel heat exchanger are of different heights.

8. A system comprising:

a first compressor configured to compress a refrigerant;

a second compressor configured to compress the refrigerant; and a high side heat exchanger configured to remove heat from the refrigerant from the first and second compressors, the high side heat exchanger comprising a first microchannel heat exchanger comprising:

a first inlet configured to receive the refrigerant from the first compressor;

a second inlet configured to receive the refrigerant from the second compressor;

a first tube comprising first microchannels;

a second tube comprising second microchannels;

a first outlet, the refrigerant received by the first inlet is directed through the first microchannels of the first tube to the first outlet;

a second outlet, the refrigerant received by the second inlet is directed through the second microchannels of the second tube to the second outlet;

a first partition configured to prevent the refrigerant received by the first inlet from flowing to the second tube; and a second partition configured to prevent the refrigerant directed through the first tube from flowing to the second outlet;

a first pipe configured to receive the refrigerant from the first outlet;

a second pipe configured to receive the refrigerant from the second outlet, wherein the first pipe is disposed to crisscross the second pipe, wherein a portion of the first pipe overlaps a portion of the second pipe between the first microchannel heat exchanger and the second microchannel heat exchanger; and a second microchannel heat exchanger comprising:

a third inlet configured to receive the refrigerant through the second pipe, wherein the second pipe couples the second outlet to the third inlet;

a fourth inlet configured to receive the refrigerant through the first pipe, wherein the first pipe couples the first outlet to the fourth inlet;

a third tube comprising third microchannels;

a fourth tube comprising fourth microchannels;

a third outlet, the refrigerant received by the third inlet is directed through the third microchannels of the third tube towards the third outlet;

a fourth outlet, the refrigerant received by the fourth inlet is directed through the fourth microchannels of the fourth tube towards the fourth outlet;

a third partition configured to prevent the refrigerant received by the third inlet from flowing to the fourth tube; and a fourth partition configured to prevent the refrigerant directed through the third tube from flowing to the fourth outlet;

wherein the first microchannel heat exchanger is positioned behind the second microchannel heat exchanger along a first direction such that air flowing in the first direction contacts the second microchannel heat exchanger before the first microchannel heat exchanger.

9. The system of claim 8, wherein the fourth outlet is positioned vertically higher than the fourth inlet.

10. The system of claim 8, wherein the fourth outlet is positioned vertically lower than the fourth inlet.

11. The system of claim 8, the first microchannel heat exchanger is staggered from the second microchannel heat exchanger such that the first microchannel heat exchanger extends vertically beyond the second microchannel heat exchanger.

12. The system of claim 8, wherein the first microchannel heat exchanger is a different length than the second microchannel heat exchanger in a second direction lateral to the first direction.

13. The system of claim 8, wherein the first outlet is positioned vertically higher than the third inlet and the second outlet is positioned vertically lower than the fourth inlet.

* * * * *